US005991583A

United States Patent [19]

Nozawa

[11] Patent Number: 5,991,583

[45] Date of Patent: Nov. 23, 1999

[54] DEVELOPING DEVICE

[75] Inventor: Taizo Nozawa, Kanagawa-ken, Japan

[73] Assignee: Kabushiki Kaisha Toshiba, Kawasaki, Japan

[21] Appl. No.: 09/042,743

[22] Filed: Mar. 17, 1998

[30] Foreign Application Priority Data

Mar. 31, 1997 [JP] Japan ..... 9-081701

[51] Int. Cl.[6] ..... G03G 15/08

[52] U.S. Cl. ..... 399/254; 399/256; 399/258; 399/260

[58] Field of Search ..... 399/254, 255, 399/256, 257, 258, 259, 260

[56] References Cited

FOREIGN PATENT DOCUMENTS

| | | | |
|---|---|---|---|
| 6-51634 | 2/1994 | Japan . | |
| 96-274386 | 4/1996 | Japan | G03G 15/08 |
| 96-319201 | 5/1996 | Japan | G03G 15/08 |

*Primary Examiner*—Richard Moses
*Assistant Examiner*—Shival Virmani
*Attorney, Agent, or Firm*—Foley & Lardner

[57] ABSTRACT

A developing device using developer and an image carrier has of a developing roller to carry developer, to feed developer to image carriers and to form a developer image. The developing device also has an upper mixer screw, which conveys, developer to the developing roller while stirring it, and a lower mixer screw provided under the upper mixer screw, which circulates and conveys developer jointly with the upper mixer also, the developing device has a drawing up roller with first and second magnetic poles formed to draw up developer when the lower mixer screw feeds developer to the upper mixer screw. The drawing up roller has magnetic matter provided in contact with the drawing up roller so as to form an angle 90° or below to the horizontal line passing through the center of axis of the developing roller between the first and second magnetic poles so that developer which is drawn up by the drawing up roller, separates so that it is re-circulated by the upper mixer screw.

32 Claims, 5 Drawing Sheets

DEVELOPING DEVICE

BACKGROUND OF THE INVENTION

1. Field of the Invention

The present invention relates to a developing device that is used in an image forming apparatus.

2. Description of the Related Art

A copying machine is much used as an image forming apparatus. In the copying machine, a developing device is used for developing an electrostatic latent image formed on an image carrier to obtain a toner image on an image receiving medium.

Of the developing devices, a two-component developing device using a developer comprising toner and carrier is also much used for color recording machines and printers from the viewpoint of image quality. In the color recording, a ratio of the image area portion is higher than the conventional monochrome recording because of image feature and toner consumption is greater by about 5 times.

Therefore, in the color recording, more toner must be supplied in a relatively short period and furthermore, a charging characteristic sufficient enough for development must be given to the toner before supplying it to the developing roller.

On the other hand, the downsizing and speed increasing of color image forming apparatuses is being progressively demanded.

In order to give a sufficient charging characteristic to toner that is supplied to the developing device, it is required to sufficiently stir and mix toner with carrier and a time required therefor, and the developing device itself must have a sufficient capacity to retain developer.

To secure the developer capacity and a stirring time described above, a means is adopted to arrange mixers in a developing device in a vertical direction instead of the conventional lateral side by side arrangement. Such a developing device with the mixers arranged in the vertical direction is called an HL type developing device.

The conventional HL type developing device has a partition wall built in the main body of the device for housing two-component developer to divide the inside of the main body into the upper and lower portions. An upper mixer is provided in the upper portion divided by the partition wall and a lower mixer is provided in the lower portion. There are specified gaps between both ends of the partition wall in the longitudinal direction and the side walls of the main body of the developing device so that developer is able to pass through the gaps freely.

At the front side of the partition wall and the upper and lower mixers, a developing roller, which is a developer carrying member, is provided.

In such a developing device, the developer that is stirred and conveyed by the upper mixer is conveyed in the specified direction and supplied to the developing roller as if falling thereto.

Developer that is not yet reaching the developing roller and excess developer remaining the developing roller after completing the development fall to the lower mixer side by gravity and then, is conveyed by the action of the lower mixer in the direction reverse to the upper mixer.

The developer conveyed by this lower mixer is again supplied to the upper mixer and is circulated and conveyed. In this case, however, as developer is conveyed from the lower mixer to the upper mixer against its gravity, there is such a problem that developer is not sufficiently supplied. To cope with this problem, a drawing up roller made of a magnet is provided at the end of the developing roller to convey developer magnetically. However, when developer is conveyed magnetically, there is still a problem.

That is, from the viewpoint of the stirring and conveying efficiency of developer in the developing device, it is preferred to separate developer from the drawing up roller completely.

However, at the end of using developer, developer was not completely separated from the drawing up roller for deterioration of fluidity of developer, change in characteristic of developer resulting from environmental change and part of developer was kept adhered to the drawing up roller.

If such a phenomenon is generated, the drawing up efficiency becomes worse and the flow of developer becomes slow throughout the entire developing device. If the flow of developer becomes slower than a certain level of speed, toner density becomes uneven, images tend to become improper and further, an automatic toner sensor may become abnormal.

Further, in the HL type developing device it is very difficult to separate developer from the drawing up roller when compared with the separation of developer from the developing roller in a horizontal type developing device not the HL type developing device.

In other words, in case of an ordinary developing roller of a horizontal type developing device, the separation point having the weakest magnetic force between magnetic poles for separating developer is set below the horizontal line of the center of axis. Therefore, the separation itself is easy because of gravity of developer, etc. and the flow of separated developer is in the constant direction at the mixer side.

On the contrary, in case of the HL type developing device which draws up developer magnetically, the separation point is above the horizontal line passing through the center of axis and the separation itself is difficult. In addition, as the flow of separated developer is in the direction reverse to the mixer, the separation of developer is more difficult.

As described above, there is so far no HL type developing device that was able to perform the drawing up and separation of developer satisfactorily.

SUMMARY OF THE INVENTION

It is an object of the present invention to provide a developing device that is able to obtain images of high quality by stably separating a developer from a drawing up member so as to maintain toner density always at a uniform level without being affected by developing characteristic change due to using frequency of developer, environmental fluctuation, etc.

According to the present invention, a developing device is provided, comprising a developing roller for carrying and supplying a developer to an image carrier to form a developer image; a first stirring/conveying member adjacent to the developing roller for conveying the developer to the developing roller while stirring the developer; a second stirring/conveying member provided below the first stirring/conveying means for circulating and conveying the developer jointly with the first stirring/conveying means; a drawing up member extending from an end of the developing roller and having a first magnetic pole and a second magnetic pole formed so as to draw up developer to the first stirring/conveying member; and a separation point provided on the drawing up member between the first and the second magnetic poles for separating the developer drawn up by the drawing up roller, wherein an angle formed between a line passing from the separation point to a center of said drawing up member and a horizontal line passing through the center of the drawing up member is no greater than 90°.

DETAILED DESCRIPTION OF THE PREFERRED EMBODIMENTS

Hereinafter, an embodiment of the present invention will be described with reference to the attached drawings.

Figure 1:
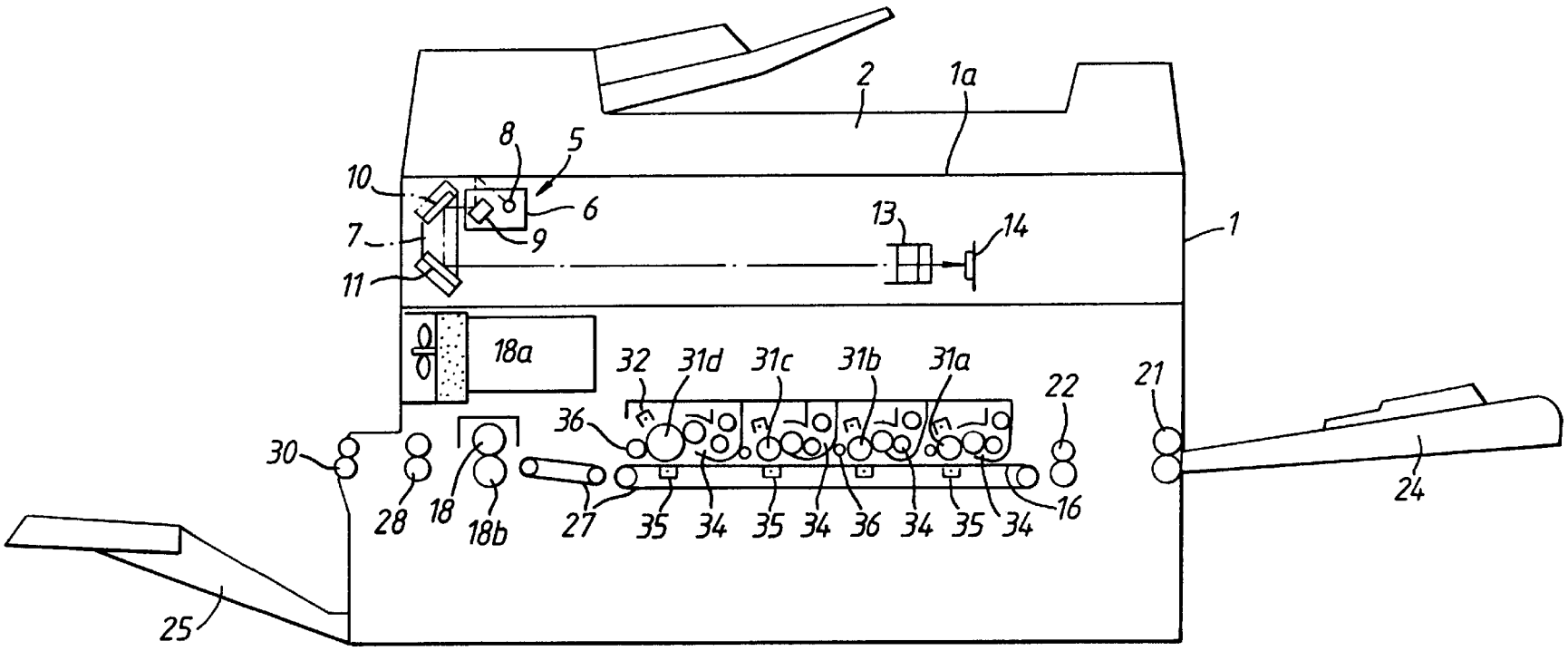
FIG. 1 is a schematic diagram showing the inner construction of a color electronic copying machine of a tandem system using a developing device of the present invention.

FIG. 1 shows a color electronic copying machine of a tetrad tandem system using developing devices of the present invention. On a document table 1*a* on the top of a main unit 1, an automatic document feeder 2 is provided to automatically feed documents.

At the upper side in the main body 1 there is provided a document scanner 5 for exposing documents. The document scanner 5 comprises first and second carriages 6 and 7 which are movable, and the first carriage 6 is provided with an exposure lamp 8 for irradiating light on the original document and a first mirror 9 for reflecting light reflected by the original document. The second carriage 7 is provided with second and third mirrors 10 and 11 for reflecting reflection light reflected by the first mirror 9, to guide reflection light in a predetermined direction. In the optical path of the light reflected by the third mirror 11, an optical lens 13 and a photoelectric conversion element 14 are provided.

At nearly the center in the main body 1, four photosensitive drums 31*a*–31*d* are provided rotatable to carry images in the paper conveying direction.

Around each of the photosensitive drums 31*a*–31*d*, there are provided a main charger 32 to uniformly charge the surfaces of the drum, a developing device 34 to develop an electrostatic latent image on the drum, a transferring device 35 to transfer a toner image on the drum onto a paper a and further, a cleaner 36 to remove residual toner in order along the rotary direction of the drum.

Further, in the main body 1 there is provided a laser beam scanning unit (not shown) to emit a laser beam according to image information. The laser beam emitted from the laser beam scanning unit is applied to the photosensitive drums 31*a*–31*d* to form an electrostatic latent image on each of the photosensitive drums 31*a*–31*d*.

Under the photosensitive drums 31*a*–31*d*, a paper conveying path 16 comprising rollers and a conveyor belt is provided in the almost horizontal state. In the paper conveying path 16, here are provided a paper feed roller 21 to feed paper, an aligning roller 22 to align paper, transferring devices 35 to transfer toner images on paper, a conveyor belt 27 to convey paper, a fixing device 18 that is a fixing means, a conveyor roller 28 and an exit roller 30 in order along the paper conveying direction.

The fixing device 18 is composed of a heat roller 18*a* and a pressure roller 18*b* which is pressure fitted to the lower side of the heat roller 18*a* to press a paper.

At one side of the main body 1, a paper supply tray 24 is provided to supply paper and at the other side, a paper receiving tray 25 is provided to receive paper exiting from the paper exit roller 30.

To form an image, place an original document on the document table 1*a* and push a copy start button (not shown).

The exposure lamp 8 lights, the first and second carriages 6 and 7 run and the original document is scanned by the light. The reflected light from the original document is received by the photoelectric conversion element 14 through the first, second and third mirrors 9, 10 and 11 and the optical lens 10 and photoelectrically converted. By the photoelectric conversion, the laser beam is emitted from the laser beam scanning unit according to image information and the laser beam is scanned by a polygon mirror. The laser beam is led and applied to the photosensitive drums 31*a*–31*d* through the optical system. The surfaces of the photosensitive drums 31*a*–31*d* are uniformly charged by the main charger 32 and an electrostatic latent image of an original document is formed when the laser beam is applied. The electrostatic latent image reaches the developing device 34 by the rotation of the photosensitive drums 31*a*–31*d* and a color toner image is formed when respective color toners are supplied.

On the other hand, paper is supplied from the paper supply tray 24 by the rotation of the paper feed roller 21 and after being aligned by the aligning roller 22, the paper is fed between the photosensitive drums 31*a*–31*d* and the transferring device 35 and a color image is transferred on the paper. After the transferring, toners left on the photosensitive drums 31*a*–31*d* are scraped and cleaned by the cleaner 36.

The paper carrying the transferred toner image is sent to the fixing device 18 when the conveyor belt 27 runs, and in the fixing device 18 it is heated, pressed and fixed. The paper carrying the fixed image is ejected in the paper receiving tray 25 by the exit roller 30.

Figure 2:
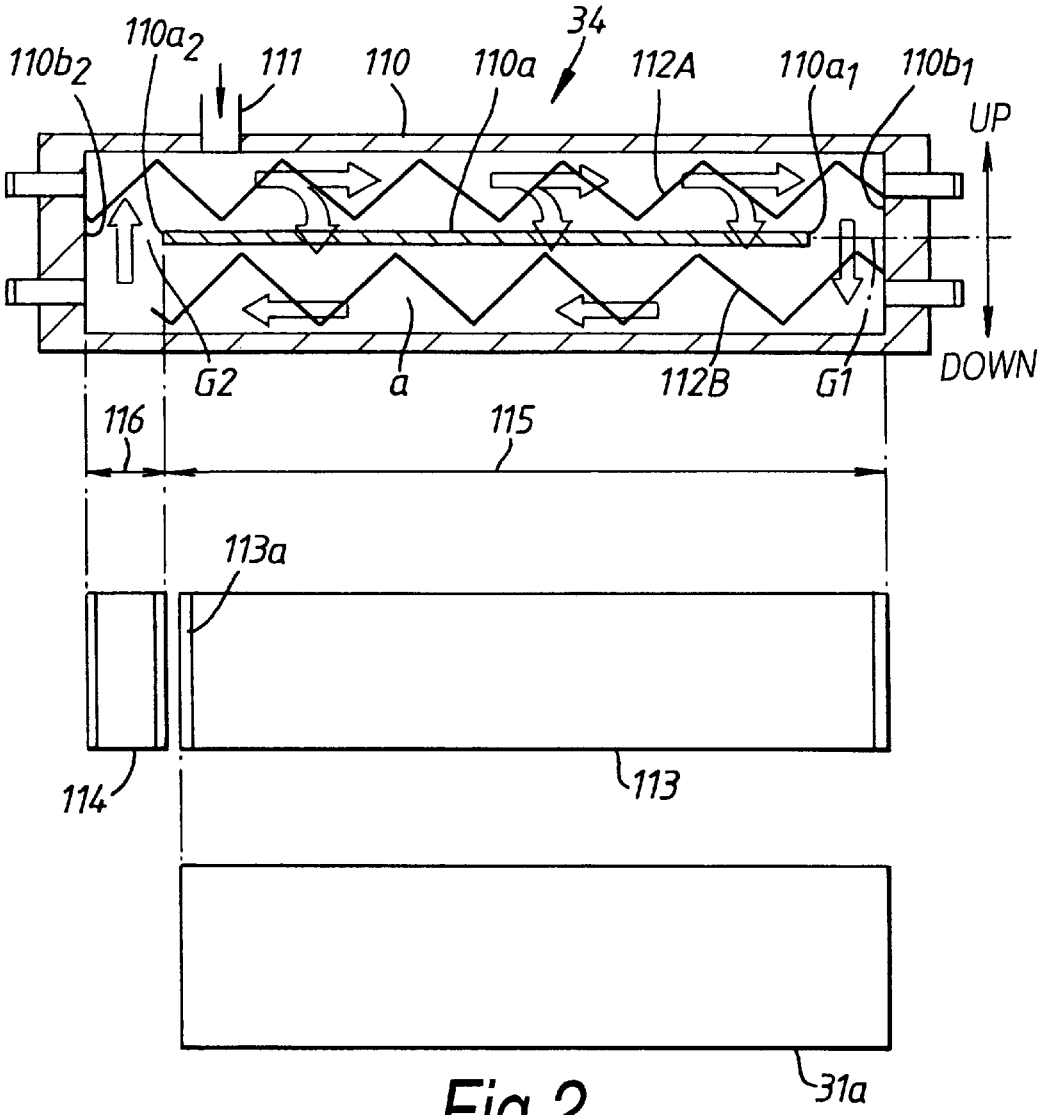
FIG. 2 is a schematic diagram showing an embodiment of the developing device of the present invention and the developing device is disassembled and schematically shown.
Figure 3:
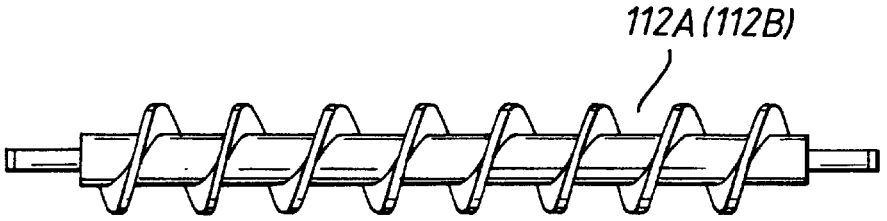
FIG. 3 is a front view showing a mixer screw that is used in the developing device of the present invention.

The developing device 34 is disassembled and schematically shown in FIG. 2. A two-component developer comprising toner and carrier is housed in a housing 110 that is a main body of the developing device. On the top surface of the housing 110, a toner supply portion 111 is provided. Toner is supplied automatically from the toner supply portion 111 according to a detection signal of a toner sensor (not shown).

A partition wall 110*a* is built in the inner wall of the housing 110 and is projecting therefrom. There are specified gaps $G_1$ and $G_2$ between both side ends $\mathbf{110}a_1$ and $\mathbf{110}a_2$ of this partition wall 110*a* and the side walls $\mathbf{110}b_1$ and $\mathbf{110}b_2$ of the housing 110, respectively and developer is able to flow through the gaps $G_1$ and $G_2$.

At the upper and lower portions of the partition wall 110*a*, an upper mixer screw (hereinafter referred to as the upper mixer) 112A and a lower mixer screw (hereinafter referred to as the lower mixer) 112B are provided in parallel with each other. The ends of the upper and lower mixers 112A and 112B are projecting from the side walls 110$b_1$ and 110$b_2$ of the housing 110 and connected to a driving mechanism (not shown) and are rotated in the reverse direction of each other.

In the housing 110, the upper mixer 112A stirs and conveys developer in the direction of the side wall 110$b_1$ side from the side wall 110*b*2 side. The lower mixer 112B stirs and conveys developer to the side wall 110$b_2$ side from the side wall 110$b_1$. That is, the upper and lower mixers 112A and 112B convey developer in the reverse directions of each other.

On the other hand, the partition wall 110*a* lies between the upper and lower mixers 112A and 112B and its end is extended to a position close to a developing roller 113 that is a developer carrying member.

The developing roller 113 is supported in an opening a provided on the housing 110. Further, a developer drawing up roller 114 is provided at one side end 113*a* of the developing roller 113 in parallel with it on the same axis.

The developing roller 113 is opposite to the partition wall 110*a* and is also opposite to the gap $G_1$ between the right side end 110$a_1$, of the partition wall 110*a* and the side wall 110$b_1$ of the housing 110. These opposite ranges are called a developer convey and stir portion 115. The drawing up roller 114 is opposite to the gap $G_2$ between the left side end 110$a_2$ of the partition wall 110*a* and the side wall 110$b_2$ of the housing 110. These opposite ranges are called a developer drawing up portion 116.

Figure 4:
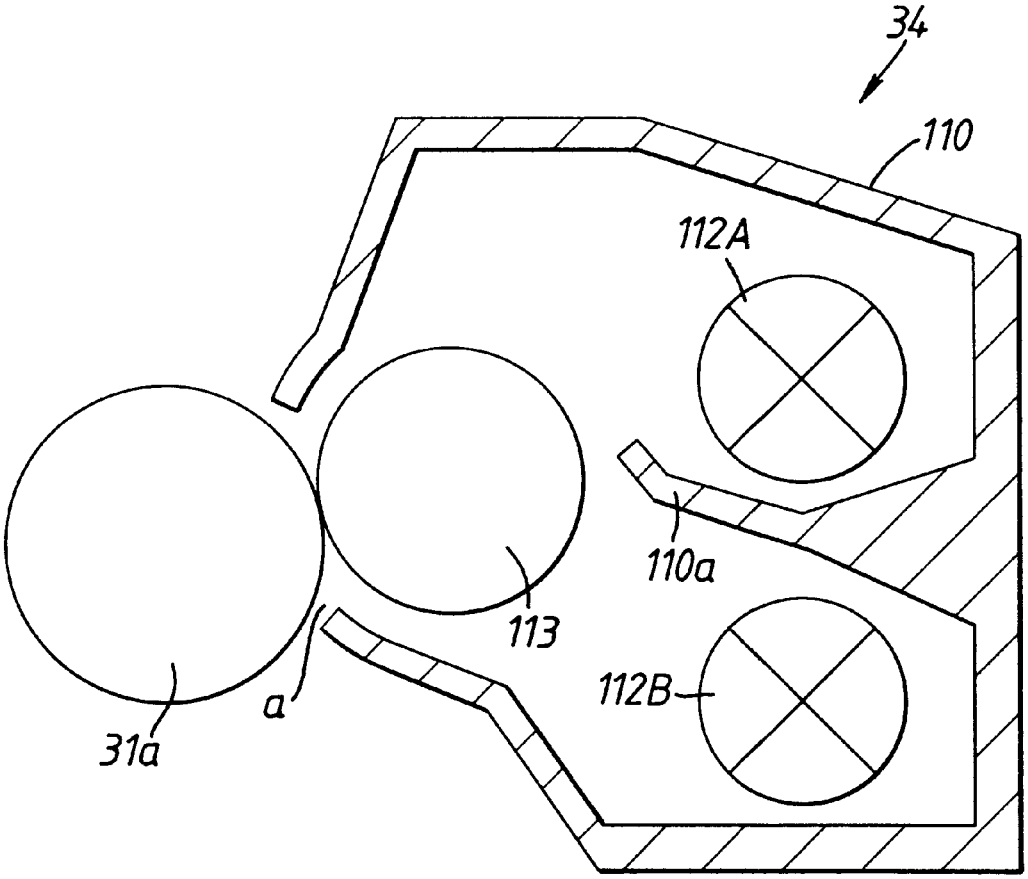
FIG. 4 is a schematic sectional view of the developing device of the present invention showing its state positioned opposite to a photosensitive drum.

The developing roller 113 is arranged opposite to the photosensitive drum 31*a* (31*b*, 31*c* and 31*d*) which is an image carrier as shown in FIG. 4.

Next, the drawing up roller 114 and the structure around it will be described in detail.

Figure 5:
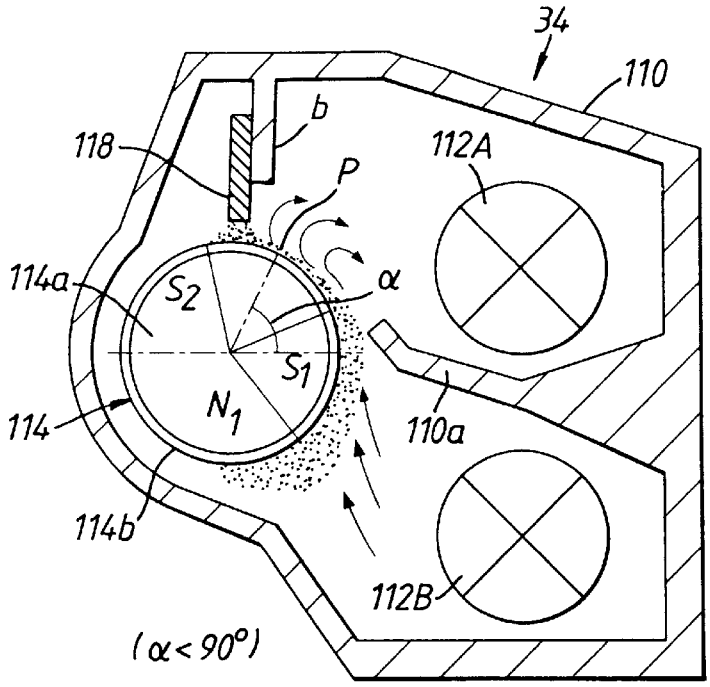
FIG. 5 is a schematic vertical sectional side view of the developing device shown in FIG. 2.

As shown in FIG. 5, the drawing up roller 114 is composed of a magnet roller 114*a* comprising 3 poles: a first magnetic pole $S_1$, a second magnetic pole $S_2$ and an $N_1$ pole that are fixed and arranged; and a rotary sleeve 114*b* composed of non-magnetic material put over the outer surface of the magnet roller 114*a*. A separation point P that is a point having the weakest magnetic force is formed between the first magnetic pole $S_1$ and the second magnetic pole $S_2$.

The separation point P is set so that an angle $\alpha$, which is based on the horizontal line passing through the center of axis of the drawing up roller 114 falls in the range below 90° ($\alpha$<90°).

The portion of the housing 110 opposite to the drawing up roller 114 is kept closed. A support portion b is built in the upper portion of the drawing up roller 114 in one united body and is projecting therefrom. A magnetic plate 118 composing the separation means is mounted to the support portion b.

The magnetic plate 118 is projecting to the drawing up roller 114 side and its lower end edge is opposite to the outer surface of the drawing up roller 114 leaving a specified space between it. And the magnetic plate 118 is provided at the downstream side near the separation point P and forms a magnetic shield between it and the second magnetic pole $S_2$.

The flow of developer in such the developing device 34 is as shown by arrows in FIG. 2. In other words, the fresh toner supplied developer stirred and conveyed in the right side direction in FIG. 2 by the upper mixer 112A falls and is supplied to the developing roller 113 in the middle (shown by the downward arrows).

The developer conveyed without being supplied to the developing roller 113 is led directly to the lower mixer 112B side through the gap $G_1$ between the right side end 110*a*1 of the partition wall 110*a* and the side wall 110*b*1 of the housing 110 and the developer once supplied to the developing roller 113 but was not carried by the photosensitive drum 31*a* (excess developer) is also led to the lower mixer 112B by its own gravity.

The developer is conveyed to the left side direction in FIG. 2 by the action of the lower mixer 112B and opposes the drawing up roller 114. Then, the developer is drawn up by the drawing up roller 114 along the developer drawing up portion 116 and is moved to the upper mixer 112A side. Thereafter, the developer is conveyed again in the same manner as described above.

The developer conveyed to the lower portion of the drawing up roller 114 by the lower mixer 112B is conveyed to the upper portion with the rotation of the sleeve 114*b* by $N_1$–$S_1$ poles comprising the drawing up roller 114.

This developer is separated from the drawing up roller 114 by the first and second magnetic poles $S_1$ and $S_2$ and is moved to the upper mixer 112A side. In particular, as the magnetic force of the separation point P is most weak between the magnetic poles $S_1$ and $S_2$, the developer arrived at the separation point P is almost completely separated and is moved.

The separation point P is set at a position where an angle $\alpha$ is <90°, the developer separated at the separation point P is naturally conveyed to the upper mixer 112A side by its own gravity.

Although, however, the developer is originally to be separated at the separation point P, part of it may not be separated and left on the sleeve 114*b*. This residual developer is moved in the counterclockwise direction with the movement of the drawing up roller 114.

This residual developer reaches between the magnetic plate 118 and the magnetic pole $S_2$ at the downstream side near the separation point P. As a magnetic shield is formed between them, the developer left on the drawing up roller 114 is certainly separated completely.

The magnetic plate 118 is not in contact with the drawing up roller 114 and therefore, it is not required to particularly consider its life and the magnetic plate 118 is extremely effective without being affected by any environmental change.

Further, as the separation point P is set at a position to make an angle $\alpha$<90°, the developer separated at this point is conveyed to the upper mixer 112A side by its own gravity as described above. In addition, as the magnetic plate 118 is set at a position near the second magnetic pole $S_2$, the magnetic shield is made more stronger. The magnetic plate 118, the magnetic shield and the support portion b act to push the separated developer back to the upper mixer 112A, assuring the movement of developer to the upper mixer 112A.

With the horizontal line passing through the center of axis of the drawing up roller 114 set at zero (0) degree, by changing an angle formed between this horizontal line and the magnetic plate 118, the separation state of developer (amount of developer left on the drawing up roller 114) from the drawing up roller 114 was evaluated. The angle formed in the direction reverse to the rotary direction of the drawing up roller 114 between the horizontal line and the magnetic plate 118 was expressed by minus (–). The results of evaluation are shown in Table 1.

TABLE 1

| Angles | Evaluated Results |
|---|---|
| −10 | Worse |
| 10 | Slightly good |
| 30 | Good |
| 50 | Good |
| 70 | Good |
| 90 | Good |
| 110 | Worse |

Figure 6:
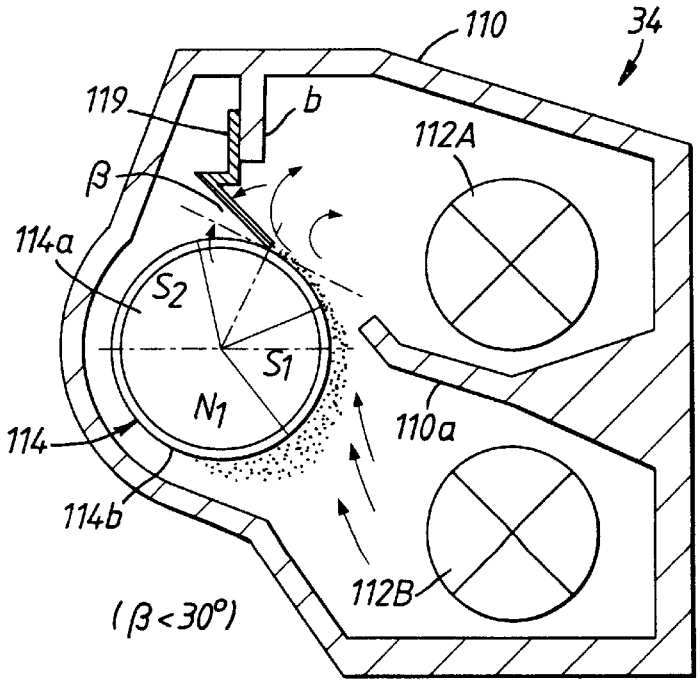
FIG. 6 is a vertical sectional side view of the developing device in another embodiment.

The separation means may be in another the structure as shown in FIG. 6. In this case, component devices other than the separation means are the same as those shown in the embodiment described before and the same reference numerals are assigned and the explanation will be omitted. Accordingly, regarding the separation point P, it is set at a position where the angle is $\alpha<90°$ for the same reason as described previously.

In this case, a scraper 119 is mounted to the support portion b of the housing 110. The scraper 119 is made of Mylar or aluminum plate and its top edge is in contact with the separation point P that is formed on the drawing up roller 114.

By considering the life of the drawing up roller 114, the contacting angle $\beta$ of the scraper 119 with the drawing up roller is set in the range below 30° ($\beta<30$ ) based on the tangent of the drawing up roller.

The above-mentioned contacting angle $\beta$ is experimentally obtained according to such conditions as surface roughness of the sandblast on the surface of the drawing up roller 114, developer conditions, prescribed life, single scraper's conditions (thickness and material), etc.

The tip of the scraper 119 contacts with a surface of the drawing up roller 114 where is positioned at mostly center between the magnetic poles S1 and S2. Since a magnetic force generated at the mostly center between the magnetic poles Sl and S2 is the weakest, the holding power of the developer on the drawing up roller is small. Therefore, if the tip of the scraper 119 contacts with the separation point P between the magnetic poles S1 and S2 of the drawing up roller, the developer can be easily separated from the drawing up roller 114.

As the magnetic force becomes at the separation point P, residual developer is separated and at the same time, developer is also separated from the drawing up roller 114 by force of the scraper 119. The scraper 119 and the support portion b act to push the separated developer back to the upper mixer 112A and the developer is certainly moved to the upper mixer 112A.

Although this HL type developing device has a portion from which a developer is hardly separated because of the drawing up roller 114 provided, it is possible to certainly separate developer from the drawing up roller 114 and supply the developer to the developing roller sufficiently.

Figure 7:
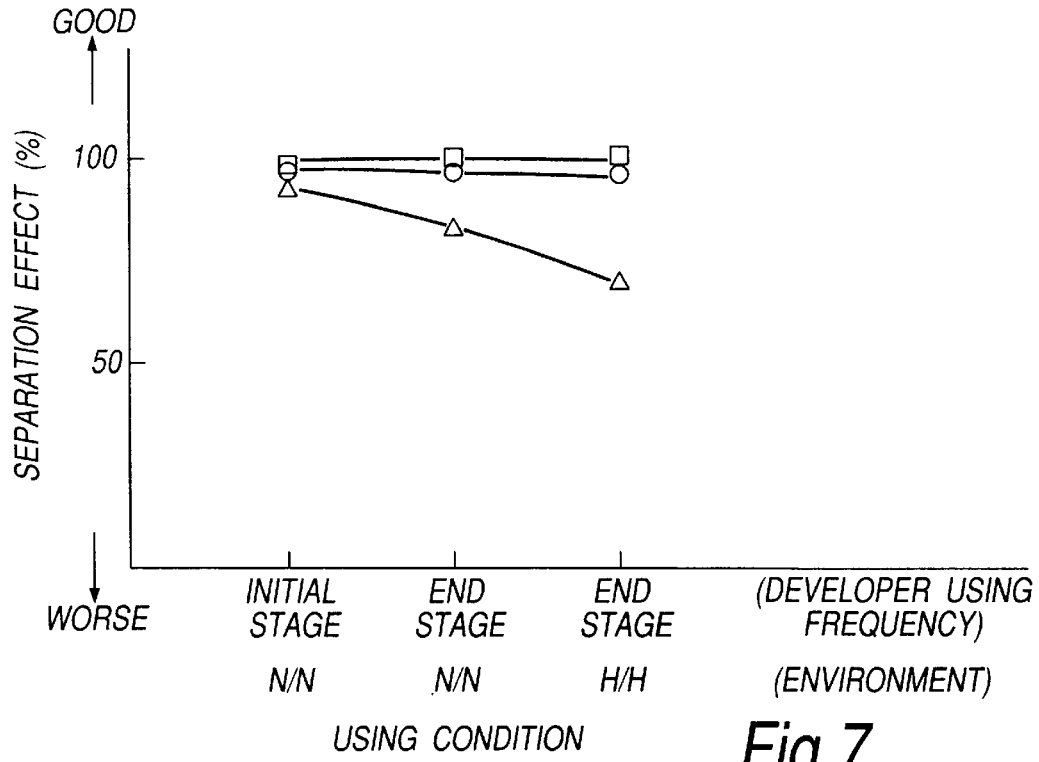
FIG. 7 is a graph showing the separation effect characteristic for using conditions by comparing a conventional developing device with that of the present invention.

FIG. 7 shows the characteristic of separation effect for using conditions. Here, a developing device in the existing structure is shown as the data of a triangular mark, the developing device of the present invention in the structure shown in FIG. 5 is shown as the data of a circular mark and the developing device in the structure shown in FIG. 6 is shown as the data of a square mark.

In case of the developing device in the existing structure (the triangular mark), it has almost the same characteristics as those of the developing devices (the circular mark and the square mark) of the present invention at the initial stage of using developer and the environmental conditions are N/N (normal temperature/normal humidity).

However, when the environmental conditions at the end of using developer are N/N, there is almost no characteristic change in the structure of the present invention, while the deterioration of characteristics is already recognized in the existing structure.

Even when the developer using frequency is the end stage and the environmental conditions are H/H (high temperature/high humidity), it is also seen that there is almost no characteristic change in the developing device in the structure of the present invention, while the remarkable deterioration of characteristic is recognized in the developing device in the existing structure.

Figure 8:
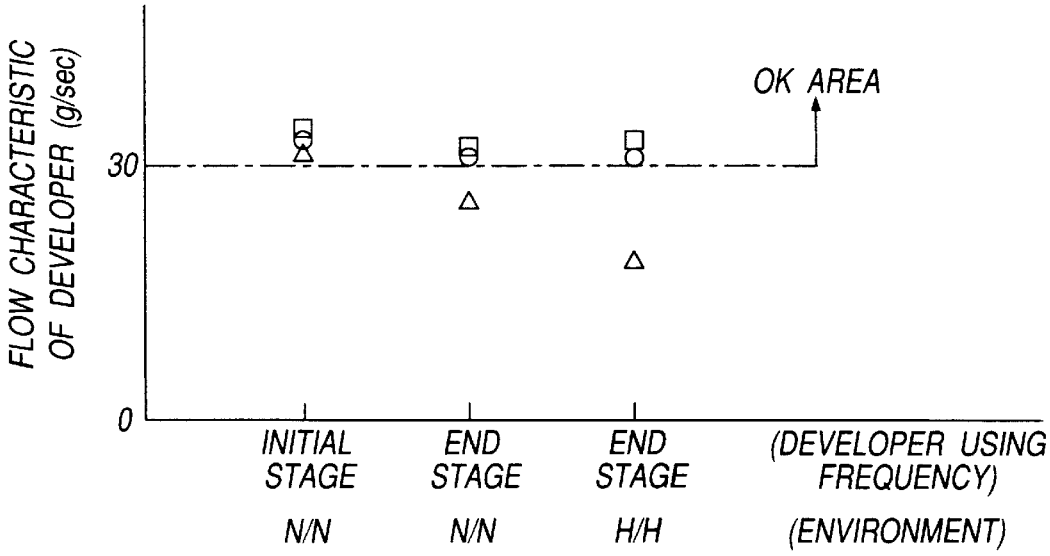
FIG. 8 is a graph showing the development flow characteristic in the developing device for using conditions by comparing a conventional developing device with that of the present invention.

FIG. 8 shows the flow characteristic of developer in the developing device for using conditions. Marks showing data are the same as those explained previously.

Here, in case of a developing device in the existing structure, it has almost the same characteristic as that of the developing device of the present invention when the developer using frequency is at the initial stage and the environmental conditions are N/N, while there is almost no characteristic change recognized in the developing device in the structure of the present invention, while it dropped from the OK area (30 g/sec.) in the developing device in the existing structure.

Then, even when the environmental conditions are N/N at the end of using developer, the characteristic remains in the OK area but the characteristic of a developing device in the existing structure drops sharply from the OK area.

As described above, a developing device of the present invention is a so-called HL type developing device and on the premise that it is provided with a drawing up roller as a drawing up means, this developing device is always able to separate developer from the magnet roller stably, make toner density uniform and thus, has an effect to provide images of high quality without being subject to any change in developing characteristic by using frequency of developer and environmental changes.

What is claimed is:

1. A developing device using developer and an image carrier, comprising:

a developing roller for carrying and supplying the developer to the image carrier to form a developer image;

a first stirring/conveying member adjacent to the developing roller for conveying the developer to the developing roller while stirring the developer;

a second stirring/conveying member provided below the first stirring/conveying member for circulating and conveying the developer jointly with the first stirring/conveying member;

a drawing up member extending from an end of the developing roller and having a first magnetic pole and a second magnetic pole formed so as to draw up the developer to the first stirring/conveying member; and a separation point provided on the drawing up member between the first and the second magnetic poles for separating the developer drawn up by the drawing up roller, wherein an angle formed between a line passing from the separation point to a center of said drawing up member and a horizontal line passing through the center of the drawing up member is no greater than 90°.

2. A developing device as claimed in claim 1, wherein the drawing up member includes:

a magnetic member having a first magnetic pole S1, a second magnetic pole S2, and an N1 pole; and a sleeve arranged so as to rotate around an outer surface of the magnetic member.

3. A developing device as claimed in claim 1, further comprising a support portion extending from the housing and a magnetic plate attached to the support portion, wherein the magnetic plate is arranged so that there is a specified space between the magnetic plate and the drawing up member.

4. A developing device as claimed in claim 1, further comprising a support portion extending from the housing a scraper mounted to the support portion and arranged so that its point is in contact with the drawing up roller.

5. A developing device as claimed in claim 4, wherein the scraper is positioned approximately at a central point between the first and second magnetic poles.

6. A developing device as claimed in claim 4, wherein an angle between the scraper and a tangent to the drawing member is no greater than 30°.

7. A developing device using developer and an image carrier, comprising:

a housing having an opening;

a toner supply portion communicating with said housing, wherein said toner supply portion supplies toner to the developing device a developer carrier arranged along the opening of the housing, wherein the developer carrier carries and supplies the developer to the image carrier;

a partition wall extending from an inner wall of said housing, wherein said partition wall divides an inside of the housing into an upper section and a lower section;

a first stirring/conveying member arranged in the upper section of the housing, wherein the first stirring/conveying member stirs the developer contained in the housing and toner supplied from the toner supply portion, conveys the developer and toner in a first direction and supplies the developer and toner to the developer carrier;

a second stirring/conveying member arranged in the lower section of the housing, wherein the second stirring/conveying member receives the developer conveyed in the first direction by the first stirring/conveying member, further stirs the developer and conveys the developer in a second direction, which is opposite to the first direction, to supply the developer to the first stirring/conveying member;

a drawing up roller having a rotary shaft with first and second magnetic poles formed, wherein the drawing up roller draws up the developer to the first stirring/conveying member; and a separation point provided on the drawing up roller between the first and the second magnetic poles for separating the developer drawn up by the drawing up roller, wherein an angle formed between a line passing from the separation point to a center of said drawing up roller and a horizontal line passing through the center of the drawing up roller is no greater than 90°.

8. A developing device as claimed in claim 7, further comprising a support portion extending from the housing and a magnetic plate attached to the support portion, wherein the magnetic plate is arranged so that there is a specified space between the magnetic plate and the drawing up roller.

9. A developing device as claimed in claim 7, further comprising a support portion extending from the housing and a scraper mounted to the support portion and arranged so that its point is in contact with the drawing up roller.

10. A developing device as claimed in claim 9, wherein an angle between the scraper and a tangent to the drawing up roller is no greater than 30°.

11. A developing device comprising:

a housing;

a partition wall projecting from an inner wall of said housing;

an upper mixer above said partition wall;

a lower mixer below said partition wall;

a developing roller mounted in an opening in said housing; and a drawing up roller mounted at one side end of said developing roller, wherein said drawing up roller includes:

a magnetic roller having a first magnetic pole, a second magnetic pole, and a third magnetic pole;

a non-magnetic rotary sleeve covering an outer surface of the magnetic roller; and a separation point between said first and second magnetic poles.

12. A developing device as claimed in claim 11, wherein an angle between a line passing from the separation point to a center of said magnetic roller and a horizontal line passing through said center of said magnetic roller is less than 90 degrees.

13. A developing device as claimed in claim 11, wherein the housing has a first side wall and a second side wall on either side of said inner wall.

14. A developing device as claimed in claim 13, further comprising a first gap between a first side end of said partition wall and said first side wall and a second gap between a second side end of said partition wall and said second side wall.

15. A developing device as claimed in claim 14, wherein a developer can flow through said first and second gaps.

16. A developing device as claimed in claim 11, wherein said upper and lower mixers are screws.

17. A developing device as claimed in claim 11, wherein said upper mixer is parallel to said lower mixer.

18. A developing device as claimed in claim 11, wherein said upper and lower mixers are each mounted to a right and left side wall of said housing.

19. A developing device as claimed in claim 11, wherein said upper and lower mixers convey and stir developer in opposite directions.

20. A developing device as claimed in claim 14, wherein said developing roller is opposite said partition wall and said first gap.

21. A developing device as claimed in claim 20, wherein said drawing up roller is opposite to said second gap.

22. A developing device as claimed in claim 21, wherein said developing roller and said drawing up roller lie on a same axis and are parallel to each other.

23. A developing device as claimed in claim 22, wherein one of the ends of said partition wall is at a position even with a space between said developing roller and said drawing up roller.

24. A developing device as claimed in claim 11, wherein said developing roller is opposite to a photosensitive drum of an image forming apparatus.

25. A developing device as claimed in claim 12, wherein a magnetic force of said separation point is weaker than a magnetic force of any point on said the magnetic roller.

26. A developing device as claimed in claim 11, wherein a portion of said housing opposite said drawing up roller is closed.

27. A developing device as claimed in claim 11, further comprising a support portion extending from said housing toward and opposite to said drawing up roller.

28. A developing device as claimed in claim 27, further comprising a magnetic plate mounted to said support portion and having a lower end opposite to an outer surface of said drawing up roller.

29. A developing device as claimed in claim 28, wherein there is a space between a lower edge of said magnetic plate and said outer surface of said drawing up roller.

30. A developing device as claimed in claim 27, further comprising a scraper mounted to said support portion.

31. A developing device as claimed in claim 30, wherein an edge of said scraper is in contact with said separation point.

32. A developing device as claimed in claim 31, wherein an angle between said edge of said scraper and said separation point is no greater than thirty degrees.

* * * * *